US008152544B1

(12) United States Patent
Hung

(10) Patent No.: US 8,152,544 B1
(45) Date of Patent: Apr. 10, 2012

(54) ENERGY-SAVING SOCKET STRUCTURE

(75) Inventor: Chiung-Hua Hung, New Taipei (TW)

(73) Assignee: Combo Cabling System Co., Ltd., New Taipei (TW)

( * ) Notice: Subject to any disclaimer, the term of this patent is extended or adjusted under 35 U.S.C. 154(b) by 0 days.

(21) Appl. No.: 12/929,550

(22) Filed: Feb. 1, 2011

(51) Int. Cl.
*H01R 29/00* (2006.01)

(52) U.S. Cl. ..... 439/188

(58) Field of Classification Search ..... 439/188, 439/441, 136; 200/314, 308, 400–401; 361/80, 361/94, 49
See application file for complete search history.

(56) References Cited

U.S. PATENT DOCUMENTS 3,439,138 A * 4/1969 Braun ..... 200/437
2003/0132093 A1* 7/2003 Huang ..... 200/314
* cited by examiner

*Primary Examiner* — Jean F Duverne
(74) *Attorney, Agent, or Firm* — Cheng-Ju Chiang

(57) ABSTRACT

An energy-saving socket includes a housing, at least one control switch, and at least one LED (Light-Emitting Diode) indicator. The housing receives therein an electrical circuit. The electrical circuit includes at least one set of electrical receptacles and one set of external power connection terminal. The housing forms at least one set of through holes corresponding to the electrical receptacles and a slot located close to the through holes. The control switch is associated with at least one set of the electrical receptacles and includes a switching pivot structure and a depression structure. The switching pivot structure is arranged inside the housing in engagement with the electrical circuit. The depression structure straddles the switching pivot and includes a pushbutton exposed through the slot. The LED indicator is received through a wall of the housing to be fixed inside the housing and is electrically connected to the electrical circuit and the control switch.

10 Claims, 11 Drawing Sheets

ENERGY-SAVING SOCKET STRUCTURE

FIELD OF THE INVENTION

The present invention relates to a structure of power-saving socket, and in particular to a power-saving socket, which features not only saving of power, but also operation safety.

BACKGROUND OF THE INVENTION

Due to greenhouse effect and also due to the current trend of environmental protection, besides development of new resources of energy to meet the need of electrical power for human societies, reduction of power consumption is one of the most important issues. The easiest way of saving power is to remove a plug of an electrical appliance or a computer from a power outlet socket. This is because that the electrical appliance will turn into a standby condition after turned off, and this makes the electrical appliance continue consuming electrical power if it remains in electrical connection with the power outlet socket. The standby power consumed by an electrical appliance is minor, but such a minor power may accumulate to a large amount, which becomes a significant loss of power. However, repeatedly plugging in and removing a plug is very tedious and troublesome for general consumers. Further, repeated insertion and removal of plugs may cause fatigue and even damage of components of the socket.

Most of the currently used power outlet sockets are wall sockets, which are mounted inside a wall, making it hard to mount and dismount. And, such a wall socket, after being dismounted from the wall, may not be used in combination with other conventional power socket. Further, the conventional power sockets are generally not provided with protected receptacles and may easily cause electrical shock to for example a child, who may accidentally contact the conductors of the receptacle or pickle the receptacle with a slender conductive article. This may also damage the socket.

Thus, the present invention aims to provide an energy-saving power socket, which also features improved operation safety and easiness of use.

SUMMARY OF THE INVENTION

An objective of the present invention is to provide an energy-saving socket, which comprises and uses a control switch to control cut-off of current so as to realize power saving and easy use without removal of plugs.

A second objective of the present invention is to provide an energy-saving socket, which comprises an arrangement of protection shutter that is helpful in preventing undesired inadvertent contact and invasion of a foreign object so as to ensure operation safety and protection against electrical shock.

A third objective of the present invention is to provide an energy-saving socket, wherein an electrical plug is integrated with a housing of the socket so as to allow the energy-saving socket of the present invention to be used in combination with an existing socket to increase the number of insertion holes and ensure easy use.

To achieve the above objectives, the present invention provides an energy-saving socket, which comprises a housing, at least one control switch, and at least one LED indicator. The housing receives therein an electrical circuit. The electrical circuit comprises at least one set of electrical receptacles and one set of external power connection terminal. The housing forms at least one set of through holes corresponding to the electrical receptacles and a slot located close to the through holes. The control switch is associated with at least one set of the electrical receptacles and comprises a switching pivot structure and a depression structure. The switching pivot structure is arranged inside the housing in engagement with the electrical circuit. The depression structure straddles the switching pivot and comprises a pushbutton exposed through the slot. The LED indicator is received through a wall of the housing to be fixed inside the housing and is electrically connected to the electrical circuit and the control switch.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

First Embodiment

With reference to the drawings and in particular to FIGS. 1-4, the present invention provides an energy-saving socket, which comprises a housing 1, a control switch 2, and an LED (Light-Emitting Diode) indicator 3.

Figure 1:
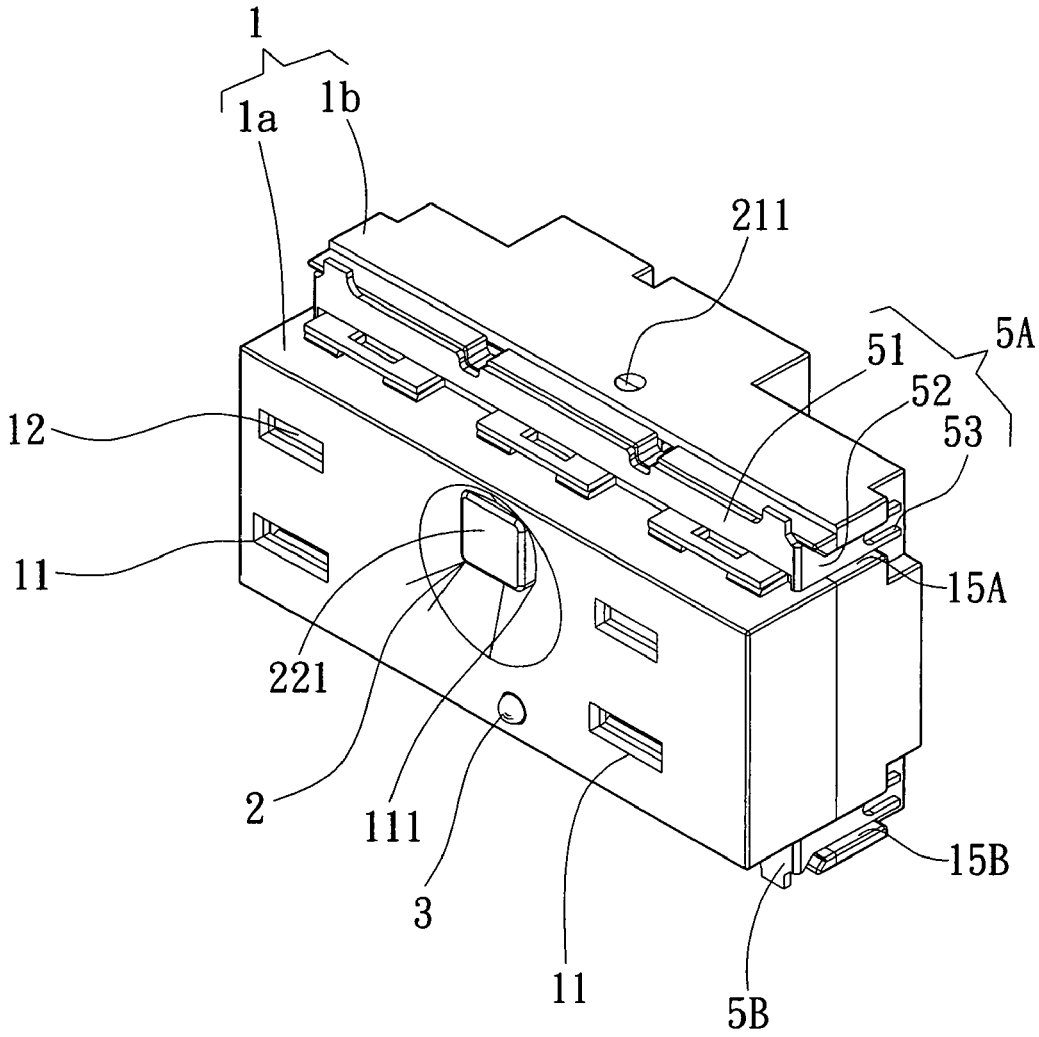
FIG. 1 is a perspective view showing an energy-saving socket according to a first embodiment of the present invention.
Figure 2:
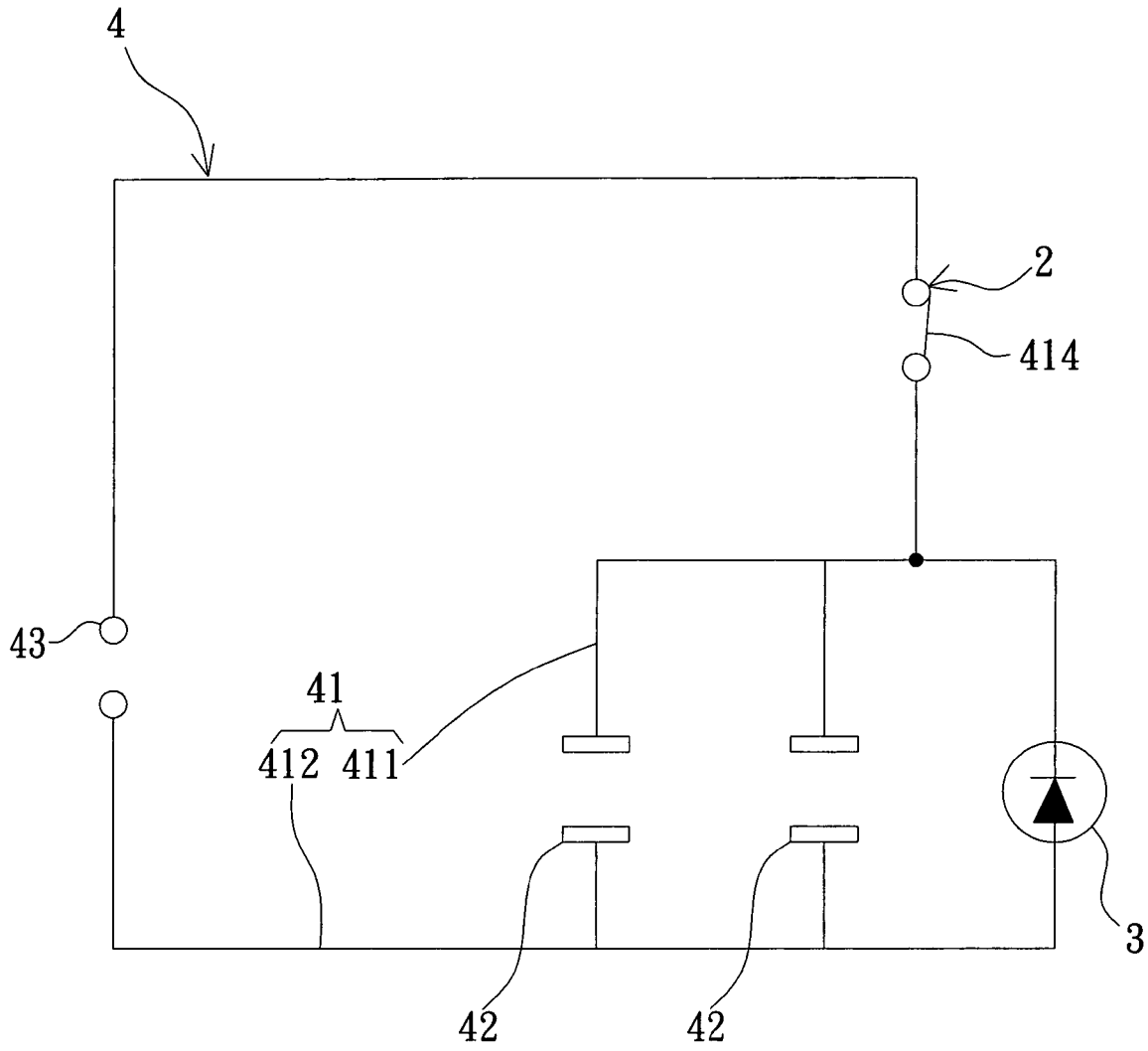
FIG. 2 is a circuit diagram of an electrical circuit of the energy-saving socket of the first embodiment of the present invention.
Figure 3:
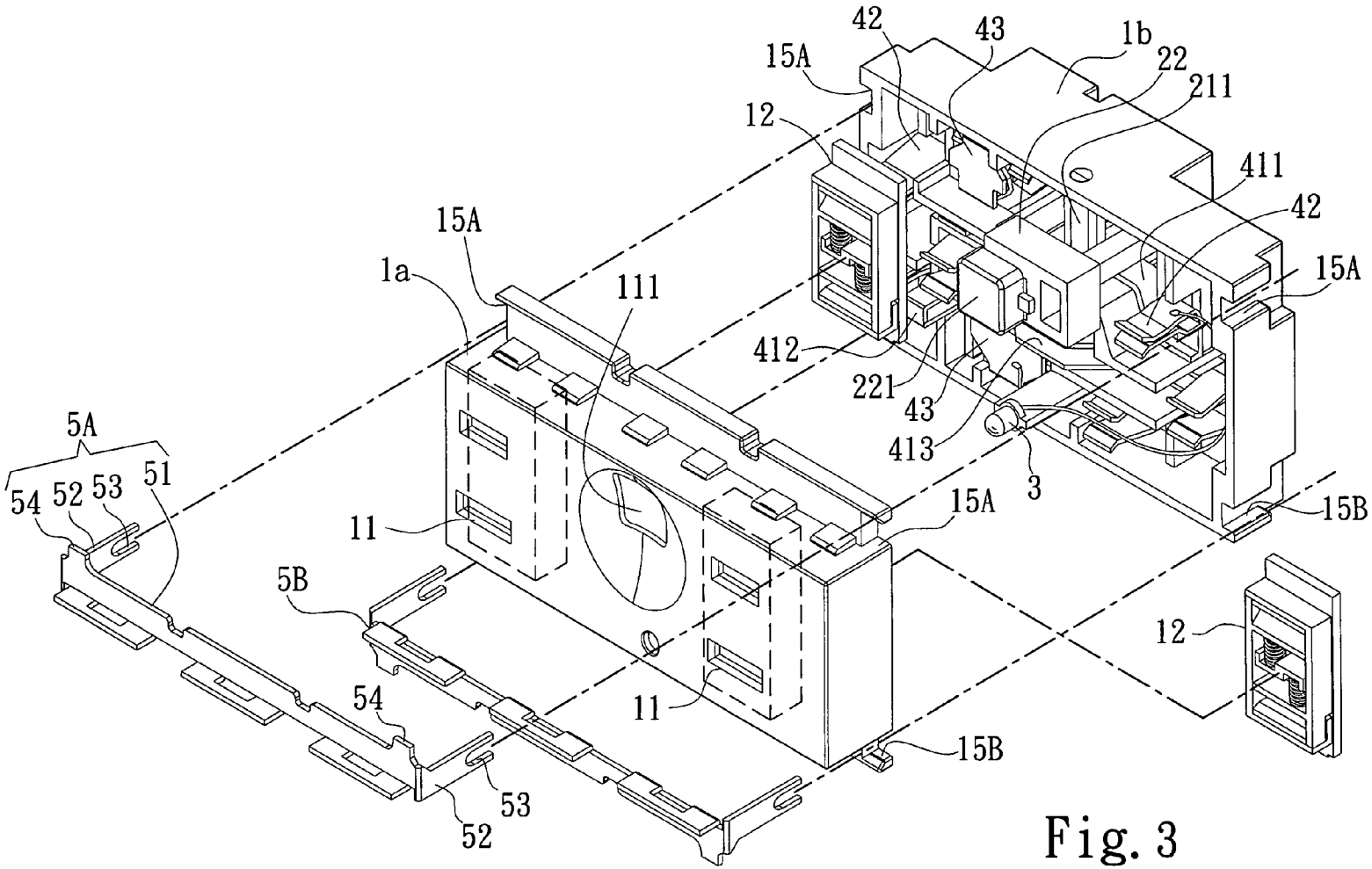
FIG. 3 is an exploded view of the energy-saving socket shown in FIG. 1.
Figure 3A:
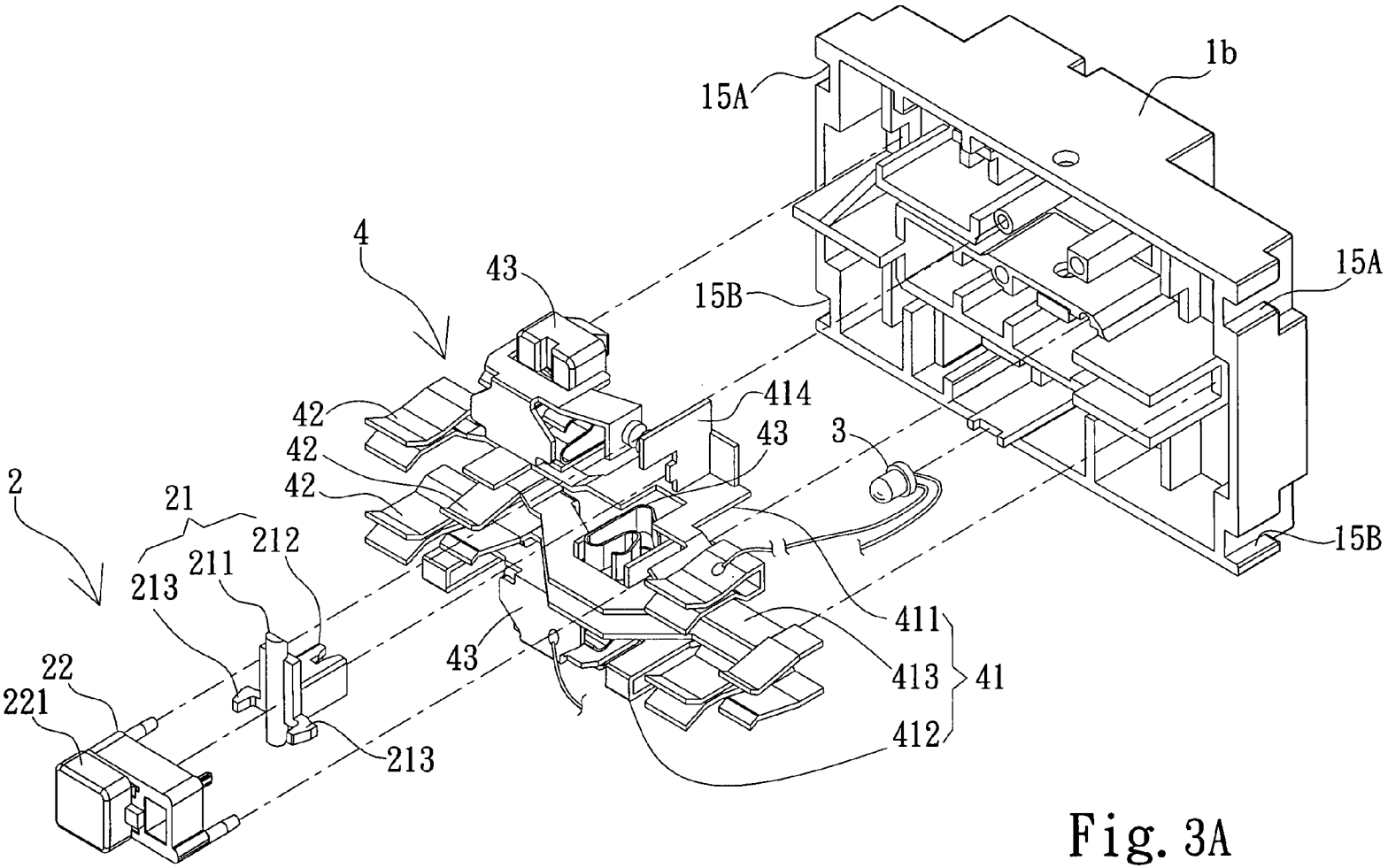
FIG. 3A is an exploded view showing an electrical circuit, a control switch, and a second enclosure member of a housing shown in FIG. 3.
Figure 3B:
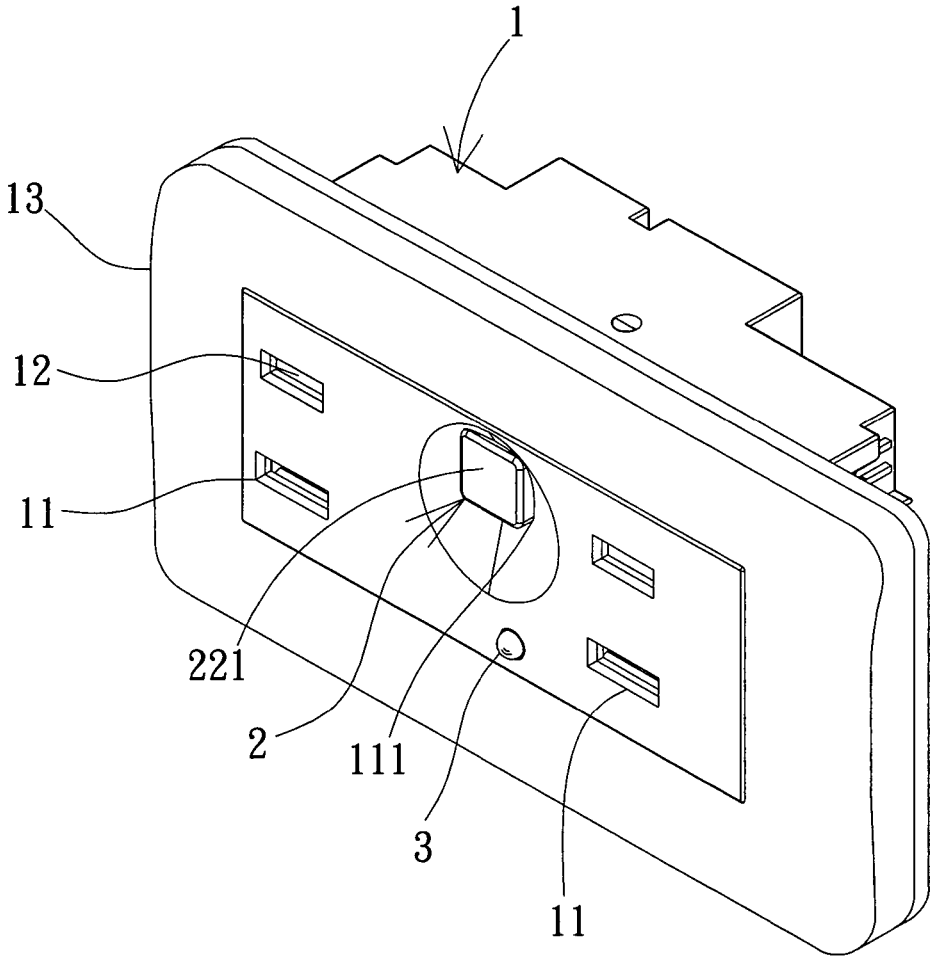
FIG. 3B is a perspective view showing an energy-saving socket according to the present invention coupled to a surface panel.
Figure 3C:
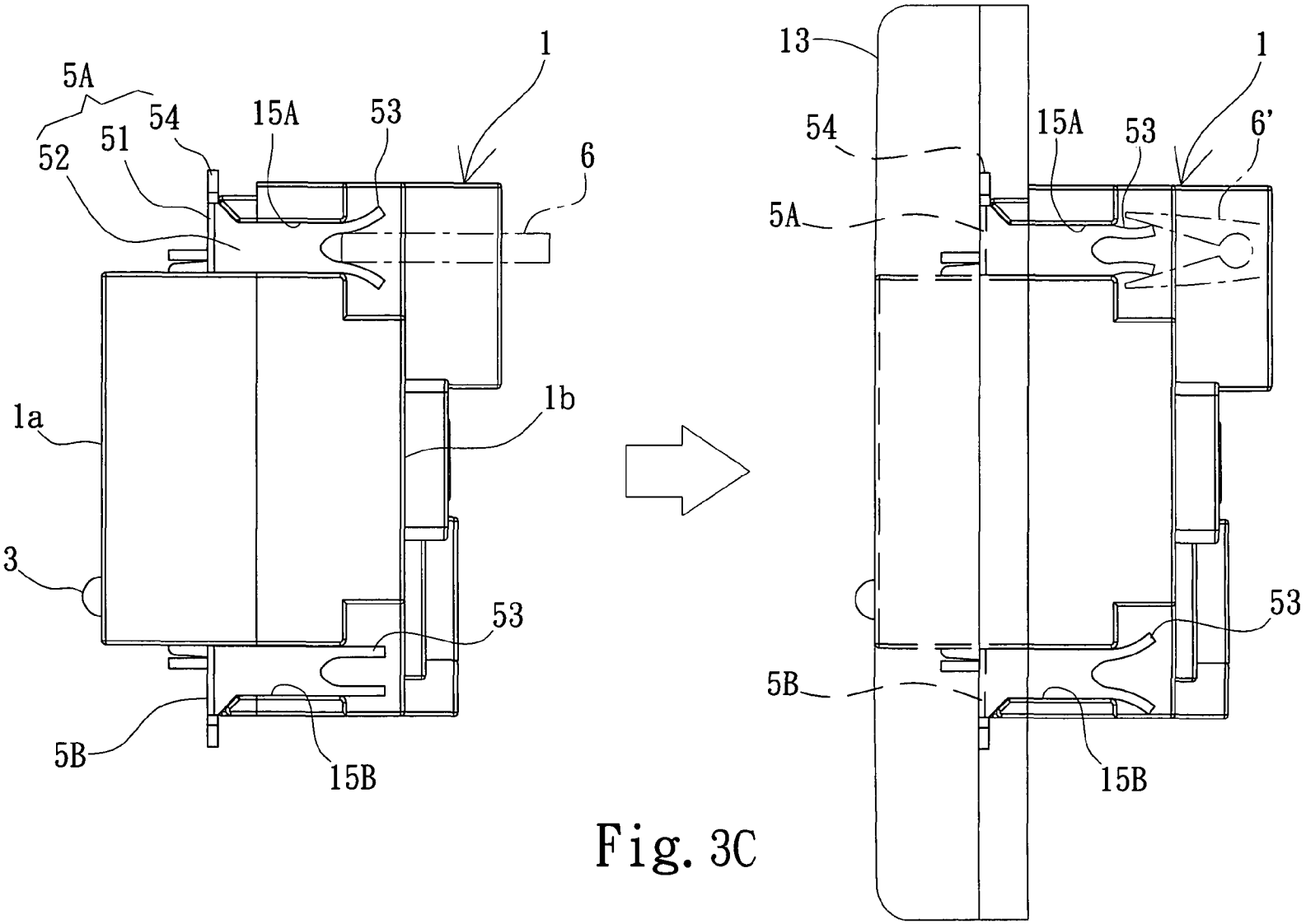
FIG. 3C illustrates securely coupling the housing with upper and lower retention racks through the use of a tool and removing a surface panel together with upper and lower retention racks also with a tool.
Figure 4:
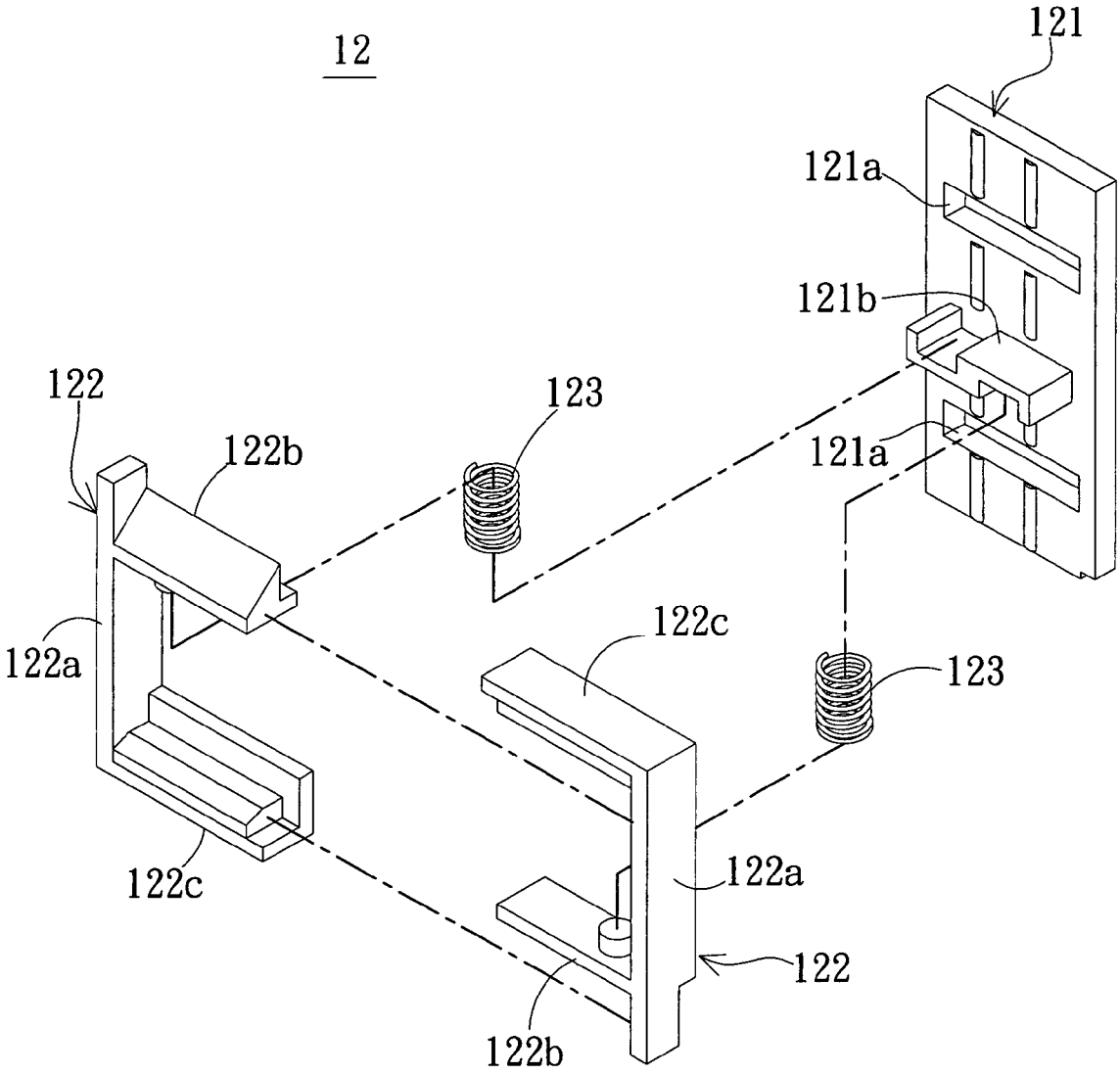
FIG. 4 is an exploded view showing a protection shutter of the energy-saving socket according to the first embodiment of the present invention.

The housing 1 (which is generally of a rectangular configuration, but not limited thereto) is composed of a first enclosure member 1*a* and a second enclosure member 1*b* (which can be coupled directly to each other or indirectly through an intermediate member). The housing 1 comprises an electrical circuit 4 arranged therein. The electrical circuit 4 is formed of metal conductors 41 and comprises at least one set of electrical receptacle 42 and one set of external power connection terminal 43. The housing 1 forms two sets of through hole 11 in a surface thereof for receiving the insertion of a plug therein. The through holes 11 are arranged to correspond in position to the electrical receptacles 42 (each set of electrical receptacle 42 being electrically connected to a voltage of 110V). The housing also forms a slot 111 at a location adjacent to the through holes 11. A protection shutter 12 is arranged internally of each set of the through hole 11 (see FIG. 3), so as to shield and close the through holes 11 when no plug insertion is made and thus provide protection against inadvertent engagement and electrical shock so caused. The protection shutter 12 is of such an arrangement that the protection shutter 12 is openable only when two blades are simultaneously inserted into the two through holes 11 of each set and this helps preventing danger caused by single blade insertion. As shown in FIG. 4, the protection shutter 12 comprises a base board 121 and two oppositely arranged movable frames 122. The base board 121 forms two openings 121*a* corresponding to the two through holes 11 and a support section 121*b* projecting between the two openings. Each of the movable frames 122 comprises a vertical section 122*a* and a first horizontal section 122*b* and a second horizontal section 122*c* that extend from one side of the vertical section 122*a* and are substantially perpendicular to the vertical section 122*a*. The two movable frames 122 are set in engagement with each other in such a way that the two first horizontal sections 122*b* are located inside the two second horizontal sections 122*c*. A spring 123 is interposed between each of the first horizontal sections 122*b* and the support section 121*b* to provide a biasing force that makes the first horizontal section 122*b* and the second horizontal section 122*c* of other frame engaging each other to thereby shield the corresponding through hole 11. Preferably, the first horizontal section 122*b* and the second horizontal section 122*c* are configured to form a V-shaped notch therebetween after engaging each other, whereby a plug, once inserted into the through hole 11, may easily push off the protection shutter 12 for effort saving.

The control switch 2 controls conduction of current therethrough or not (and is preferably of a pushbutton type, but not limited thereto) and is arranged to associate with one set of electrical receptacle 42 and comprises a switching pivot structure 21 and a depression structure 22. The switching pivot structure 21 is arranged inside the housing 1 to have one side thereof in engagement with the electrical circuit 4. The depression structure 22, which is set to straddle the switching pivot 21, comprises a pushbutton 221 exposed through the slot 111. Preferably, the housing 1 forms in a surface thereof a recess in which the slot 111 is formed, whereby an operation face of the pushbutton 221 is set flush with (or slightly recessed with respect to) the surface of the housing 1, in order to eliminate the potential risk of inadvertent actuation and thus improperly affecting the operation of the control switch 2 in plugging and/or removing a plug. When the control switch 2 is in an ON state (shorted state), the energy-saving socket is set in a standby mode and ready for receiving a plug of an electrical appliance to insert therein. After the user of the electrical appliance, an actuation of the control switch 2 is made to switch the socket into an OFF state (open state), which blocks the passage of current, whereby completely no electrical current flows through the energy-saving socket and no electrical power is consumed even the plug is not removed.

The LED indicator 3 (which can be of any desired color) is received through a wall of the housing 1 so as to be fixed to the housing 1. The LED indicator 3 is in electrical connection with the electrical circuit 4 and the control switch 2.

Referring to FIGS. 2, 3, and 3A-3C, the metal conductors 41 of the electrical circuit 4 are mounted inside the housing 1 and comprise a first metal conductor 411 and a second metal conductor 412. Each set of the electrical receptacle 42 has receptacle members respectively connected to the first metal conductor 411 and the second metal conductor 412, and each set of the external power connection terminal 43 comprises a terminal connected to the first metal conductor 411 and a terminal connected to the second metal conductor 412 for selectively connecting to an external power source. The first metal conductor 411 comprises a resilient conductive structure 414 (which is preferably formed of a metal plate) mounted thereto. The resilient conductive structure 414 has one end coupled to the switching pivot structure 21 and an opposite end arranged close to and opposing the external power connection terminals 43.

The switching pivot structure 21 comprises a pivot pin 211, a retention seat 212, and two sideway projections 213. The retention seat 212 is attached to the pivot pin 211 and receives the resilient conductive structure 414 to fit therein. The two sideway projections 213 are respectively and symmetrically formed on opposite sides of the pivot pin 211. The pivot pin 211 is set inside the housing 1. Depression of the pushbutton 221 forces the depression structure 22 to depress the sideway projections 213 and cause rotation of the pivot pin 211, which in turn drives the retention seat 212 to move the resilient conductive structure 414 into engagement with the external power connection terminals 43 for electrical conduction. The LED indicator 3 is connected in parallel to the electrical receptacle 42 and is further connected in series with the control switch 2.

The housing 1 forms, in opposite side surfaces thereof, an upper retention slot 15A and a lower retention slot 15B. The housing 1 is also provided, on upper and lower sides thereof, with an upper retention rack 5A and a lower retention rack 5B, which are of identical structure. Each retention rack comprises an engagement section 51 and two clamping sections 52. Each clamping section 52 has a distal end forming a bifurcation structure 53. The upper and lower retention slots 15A, 15B respectively receive the insertion of the bifurcation structures 53 of the clamping sections 52 therethrough. Afterwards, the bifurcation structures 53 are expanded to realize retention and fixation, whereby the first enclosure member 1*a* and the second enclosure member 1*b* of the housing 1 are tightly secured together. In practice, a tool 6 may be employed to expand the bifurcation structure 53 (see left hand portion of FIG. 3C).

Further, the engagement section 51 of the upper retention rack 5A and the lower retention rack 5B forms at least one clip section 54, which, when the socket is used, allows the housing 1 to coupled to a surface panel 13 to form an embedded socket. The surface panel 13 is of a conventional structure. To disassemble, the surface panel 13 can be directly removed or a tool 6' is used to dismount the surface panel 13, together with the upper and lower retention racks 5A, 5B (see right hand portion of FIG. 3C).

Second Embodiment

Figure 5:
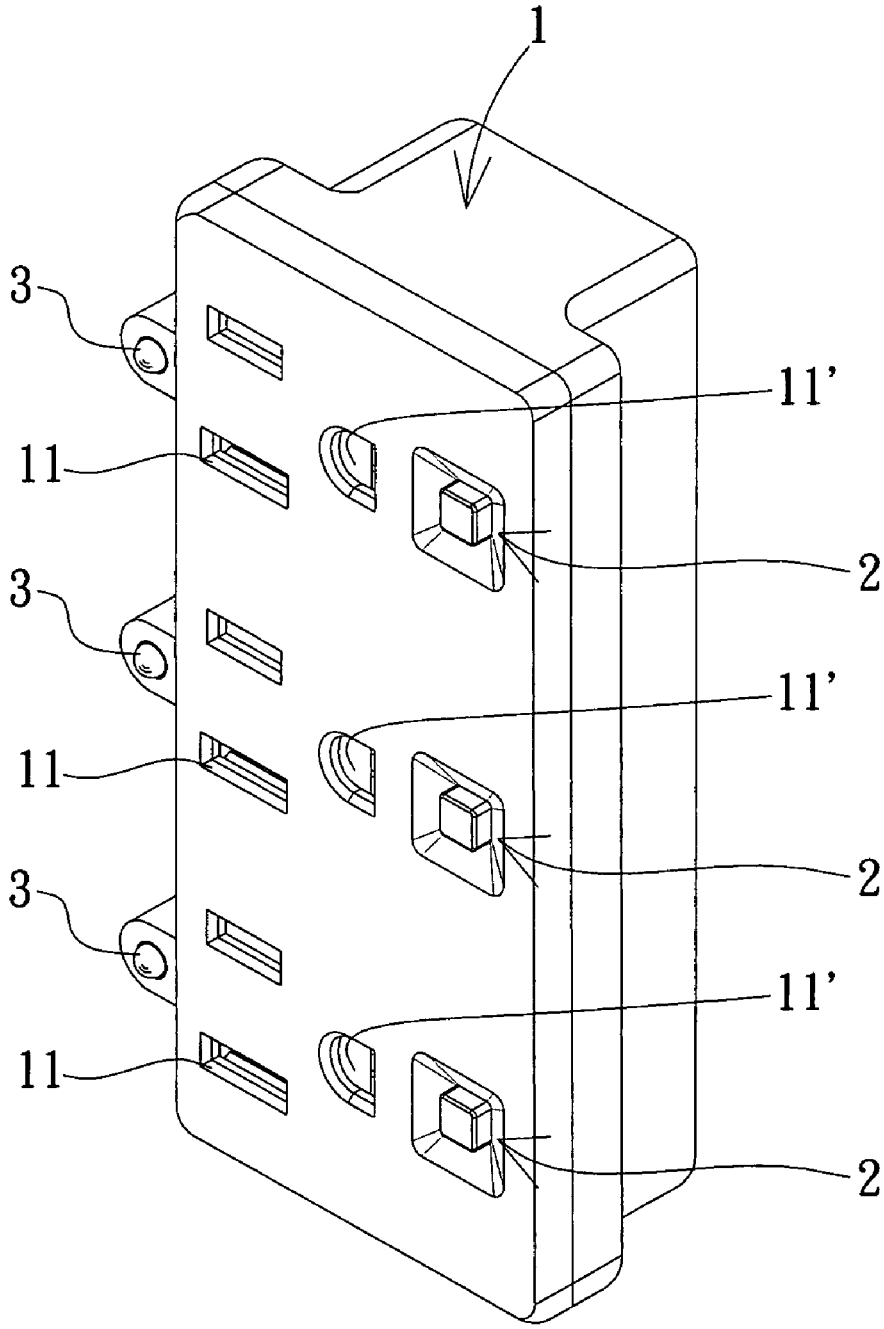
FIG. 5 is a perspective view showing an energy-saving socket according to a second embodiment of the present invention.

Referring to FIG. 5, a second embodiment is shown and is substantially identical to the first embodiment with a difference being that the energy-saving socket of the second embodiment comprises a housing 1, three control switches 2, and three LED indicators 3, but does not comprises the upper and lower retention racks 5A, 5B and the surface panel 13. The second embodiment is formed as a standalone socket. The housing 1 is substantially rectangular. The housing 1 forms three sets of through holes 11, 11' and three sets of electrical receptacle 42 (all being in connection with a voltage of 110V). In the instant embodiment, besides the first metal conductor 411 and the second metal conductor 412, the metal conductors 41 of the electrical circuit 4 further comprises a third metal conductor 413. The third metal conductor 413 (which is preferably grounded) is also provided with an electrical receptacle (corresponding to the through hole 11' in the drawing) and an external power connection terminal. Each set of electrical receptacles 42 is provided with one LED indicator 3, and each set of electrical receptacles 42 is controlled by a control switch 2 to selectively switch between a standby mode and a cut-off mode. As such, when some electrical appliances connected to the socket are not in use, the associated electrical receptacles 42 may be selectively cut off and this improves the convenience of use of the socket.

Third Embodiment

Figure 6:
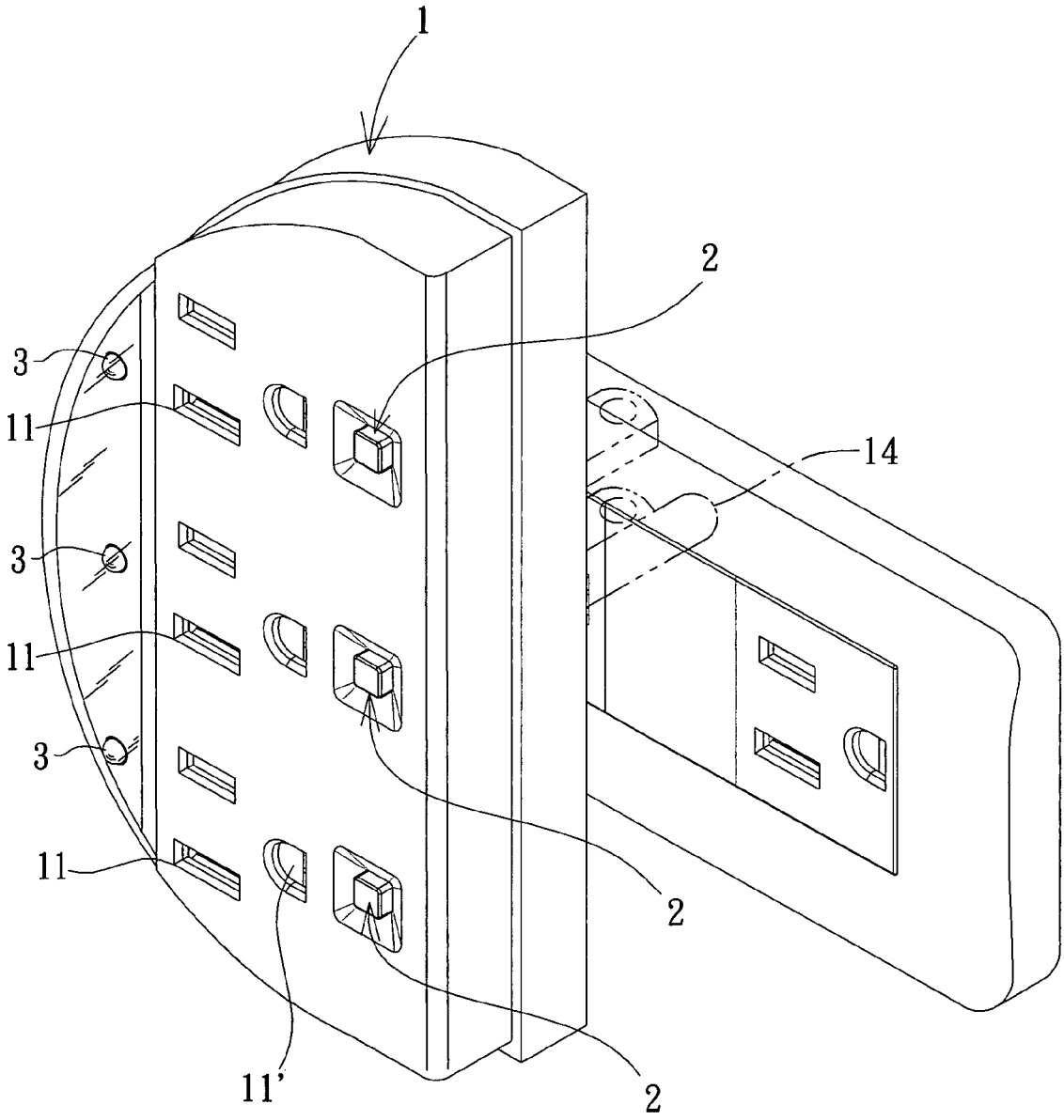
FIG. 6 is a perspective view showing an energy-saving socket according to a third embodiment of the present invention.
Figure 7:
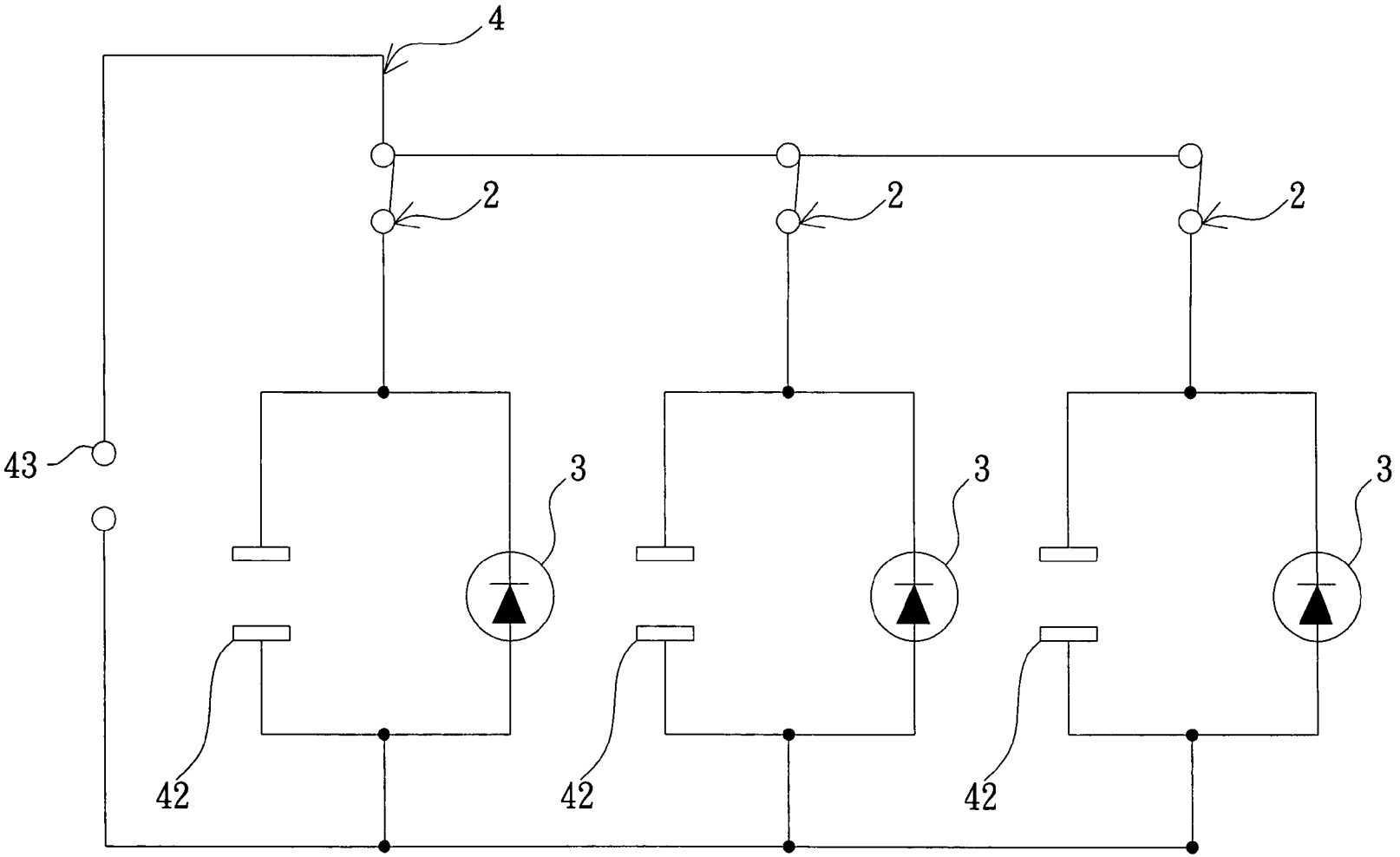
FIG. 7 is a circuit diagram of an electrical circuit of the energy-saving socket of the third embodiment of the present invention.

Referring to FIGS. 6 and 7, a third embodiment is shown and is of substantially the same structure as the second embodiment. A difference resides in that the housing 1 is made in the form a curved post like body. The housing 1 comprises an electrical plug 14, which is mounted to a back side of the housing 1 and is in electrical connection with the electrical circuit 4. As such, the energy-saving socket according to the present invention can be used in combination with another conventional socket (which may alternatively be a socket having a structure according to the present invention), to increase the number of through holes for receiving the insertion of additional plugs.

Fourth Embodiment

Figure 8:
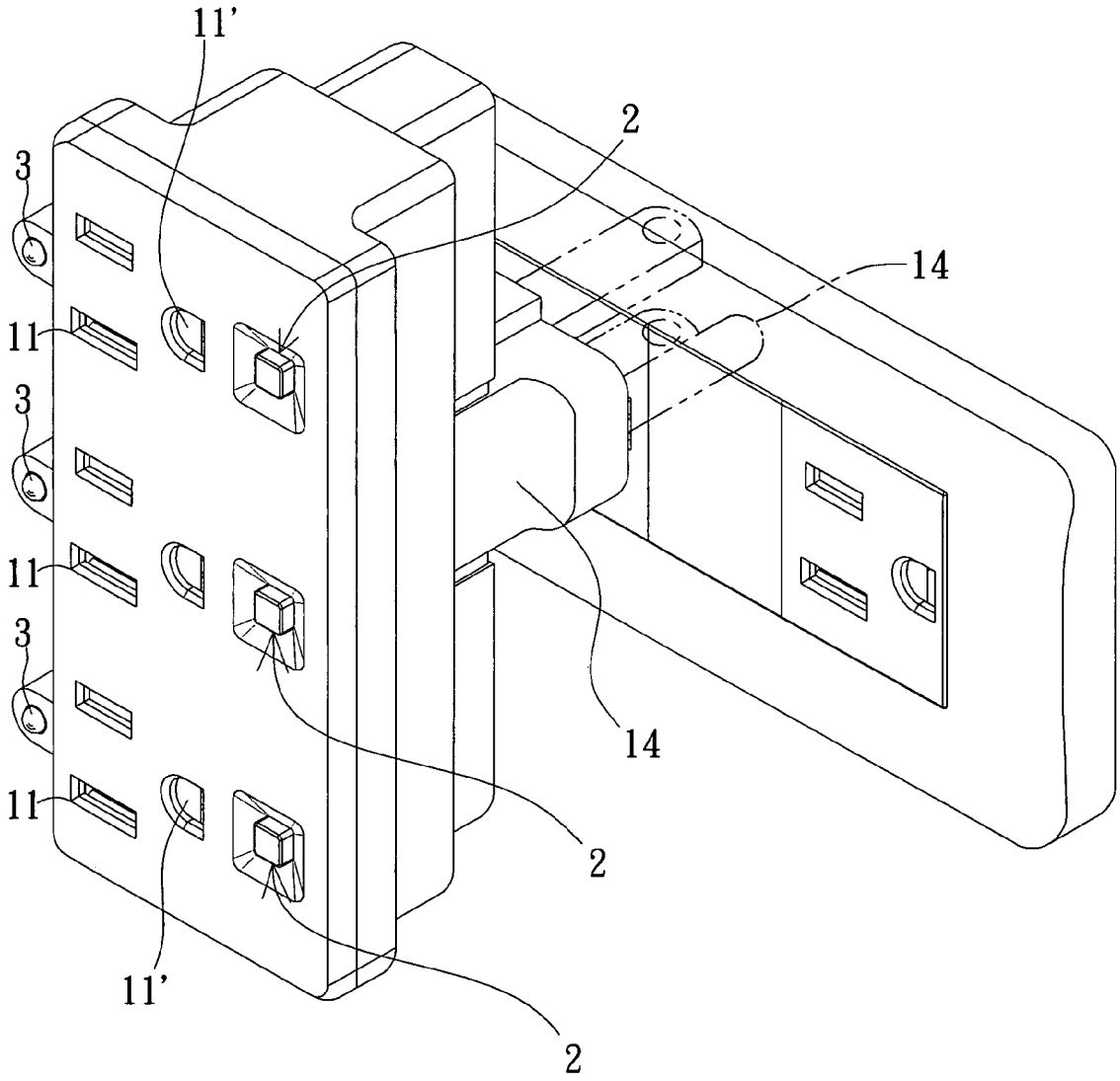
FIG. 8 is a perspective view showing an energy-saving socket according to a fourth embodiment of the present invention.

Referring to FIG. 8, a fourth embodiment is shown and is of substantially the same structure as the third embodiment. A difference resides in that the electrical plug 14 is mounted, in a rotatable manner, to a side surface of the housing 1. The electrical plug 14 is electrically connected to the electrical circuit 4. As such, the energy-saving socket according to the present invention can be combined with another conventional socket (which may alternatively be an embedded socket according to the present invention), to increase the number of through holes and electrical receptacles and to selectively change insertion direction of a plug of an electrical appliance.

It is apparent that the electrical receptacle 42 of the energy-saving socket according to the present invention may be selectively supplied with a voltage of 220V and still provides the same functionality.

In summary, the present invention provides an energy-saving socket, of which the features are that cut-off of electrical current is controlled by the control switch 2 so that power saving and convenience of use can be realized without removal of plugs. Further, the arrangement of the protection shutter 12 is helpful in preventing undesired inadvertent contact and/or invasion of a foreign object so as to ensure operation safety and protection against electrical shock. Further, with an electrical plug 14 integrated to the housing 1, the energy-saving socket according to the present invention can be selectively used in combination with an existing socket to increase the number of through holes and the electrical receptacles and ensure easy use.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An energy-saving socket, comprising:

a housing, which receives therein an electrical circuit, the electrical circuit being formed of metal conductors and comprising at least one set of electrical receptacles and one set of external power connection terminal, the housing having a surface forming at least one set of through holes corresponding to the electrical receptacles and a slot located close to the through holes;

at least one control switch, which is associated with at least one set of the electrical receptacles, the control switch comprising a switching pivot structure and a depression structure, the switching pivot structure being arranged inside the housing to have a side thereof in engagement with the electrical circuit, the depression structure straddling the switching pivot and comprising a pushbutton exposed through the slot; and at least one LED indicator, which is arranged in the housing to have an end of the LED indicator exposed through a surface of the housing, the LED indicator being electrically connected to the electrical circuit and the control switch.

2. The energy-saving socket as claimed in claim 1, wherein the metal conductors are mounted inside the housing and comprise a first metal conductor and a second metal conductor, the first metal conductor comprising a resilient conductive structure mounted thereto, the resilient conductive structure having an end coupled to the switching pivot structure and an opposite end arranged close to and opposing the external power connection terminals.

3. The energy-saving socket as claimed in claim 2, wherein the switching pivot structure comprises a pivot pin, a retention seat, and two sideway projections, the retention seat being attached to the pivot pin and receiving the resilient conductive structure to fit therein, the sideway projections being respectively and symmetrically formed on opposite sides of the pivot pin, the pivot pin being set inside the housing.

4. The energy-saving socket as claimed in claim 2, wherein the metal conductors comprise a third metal conductor.

5. The energy-saving socket as claimed in claim 1, wherein the housing forms, in opposite surfaces thereof, an upper retention slot and a lower retention slot, the housing comprising an upper retention rack and a lower retention rack on upper and lower sides thereof, each of the retention racks comprising an engagement section and two clamping sections, each of the clamping sections having a distal end forming a bifurcation structure, the upper and lower retention slots respectively receiving insertion of the bifurcation structures of the clamping sections therethrough to allow the bifurcation structures to be subsequently expanded for retention purposes.

6. The energy-saving socket as claimed in claim 5, wherein the engagement section of each of the upper retention rack and the lower retention rack forms at least one clip section for coupling the housing to a surface panel.

7. The energy-saving socket as claimed in claim 1, wherein the housing forms one of a standalone socket and an embedded socket.

8. The energy-saving socket as claimed in claim 1, wherein the housing receives therein a protection shutter corresponding to the electrical receptacle, the protection shutter comprising a base board and two oppositely arranged movable frames, the base board forming two openings corresponding to the electrical receptacle and a support section between the openings, each of the movable frames comprising a vertical section and a first horizontal section and a second horizontal section that extend from one side of the vertical section and are substantially perpendicular to the vertical section, the two movable frames being set in engagement with each other so that the two first horizontal sections are located inside the two second horizontal sections, a spring being interposed between each of the first horizontal sections and the support section to provide a biasing force that makes the first horizontal section engaging the second horizontal section of the other frame.

9. The energy-saving socket as claimed in claim 1, wherein the housing further comprises an electrical plug in electrical connection with the electrical circuit.

10. The energy-saving socket as claimed in claim 1, wherein the electrical receptacles are provided with a voltage of one of 110V and 220V.

* * * * *